US009627733B2

(12) United States Patent
Kawamura et al.

(10) Patent No.: US 9,627,733 B2
(45) **Date of Patent: *Apr. 18, 2017**

(54) MILLIMETER WAVEBAND FILTER

(71) Applicant: ANRITSU CORPORATION, Atsugi-shi, Kanagawa (JP)

(72) Inventors: Takashi Kawamura, Kanagawa (JP); Hiroshi Shimotahira, Kanagawa (JP)

(73) Assignee: ANRITSU CORPORATION, Kanagawa (JP)

( * ) Notice: Subject to any disclaimer, the term of this patent is extended or adjusted under 35 U.S.C. 154(b) by 9 days.

This patent is subject to a terminal disclaimer.

(21) Appl. No.: 14/644,776

(22) Filed: Mar. 11, 2015

(65) Prior Publication Data

US 2015/0288045 A1 Oct. 8, 2015

(30) Foreign Application Priority Data

Apr. 7, 2014 (JP) ..... 2014-078952

(51) Int. Cl.
*H01P 1/208* (2006.01)

(52) U.S. Cl.
CPC ..... *H01P 1/208* (2013.01)

(58) Field of Classification Search
CPC ..... H01P 1/208
USPC ..... 333/209
See application file for complete search history.

(56) References Cited

U.S. PATENT DOCUMENTS 4,283,727 A * 8/1981 Martel ..... H01P 1/061 333/257
2008/0001686 A1* 1/2008 Chao ..... H01P 1/042 333/254
2012/0242428 A1* 9/2012 Blech ..... H01P 1/165 333/257
2013/0135063 A1* 5/2013 Kawamura ..... H01P 7/06 333/209

FOREIGN PATENT DOCUMENTS

JP 2013-138401 A 11/2013

* cited by examiner

*Primary Examiner* — Stephen E Jones
*Assistant Examiner* — Scott S Outten
(74) *Attorney, Agent, or Firm* — Pearne & Gordon LLP

(57) ABSTRACT

To provide a millimeter waveband filter which can vary a resonance frequency in a wider band without causing deterioration of resonance characteristics due to leakage of electromagnetic waves. In a millimeter waveband filter 20, a first waveguides 22 and a second waveguide 24 are relatively moved to vary the interval between the electric wave half mirrors 30A and 30B, and the resonance frequency of a resonator formed between the mirrors varies to selectively transmit resonance frequency components. A groove 60 which has a length p along a longitudinal direction of the transmission line corresponding to a ¼ wavelength of electromagnetic waves to be a leakage prevention target is provided on the outside of the second waveguide 24 facing the inside of the first waveguide 22, thereby preventing leakage of electromagnetic waves from the gap between the first waveguide 22 and the second waveguide 24.

8 Claims, 10 Drawing Sheets

MILLIMETER WAVEBAND FILTER

TECHNICAL FIELD

The present invention relates to a filter which is used in a millimeter waveband.

BACKGROUND ART

In recent years, there is an increasing need for the use of electric waves in response to a ubiquitous network society, and a wireless personal area network (WPAN) which realizes wireless broadband at home or a millimeter waveband wireless system, such as a millimeter-wave radar, which supports safe and secure driving starts to be used. An effort to realize a wireless system at a frequency equal to or greater than 100 GHz is actively made.

In regard to second harmonic evaluation of a wireless system in a 60 to 70 GHz band or evaluation of a radio signal in a frequency band equal to or greater than 100 GHz, as the frequency becomes high, the noise level of a measurement device and conversion loss of a mixer increase and frequency precision is lowered. For this reason, a high-sensitivity and high-precision measurement technology of a radio signal over 100 GHz has not been established. In the conventional measurement technology, it is not possible to separate harmonics of local oscillation from the measurement result, and there is difficulty in strict measurement of unnecessary emission or the like.

In order to overcome the problems in the related art and to realize high-sensitivity and high-precision measurement of a radio signal in a frequency band equal to or greater than 100 GHz, it is necessary to develop a narrowband filter technology of a millimeter waveband for the purpose of suppressing an image response and a high-order harmonic response, and in particular, there is a demand for a technology which is adaptable to a variable frequency type (tunable).

In order to realize this, the applicant has suggested a millimeter waveband filter in which a Fabry-Perot resonator used in an optical field is applied to millimeter waves and desired frequency components of the millimeter waves are selectively transmitted by a resonance action between a pair of electric wave half mirrors arranged to face each other inside a transmission line allowing propagation in a TE10 mode (single mode) (Patent Document 1).

RELATED ART DOCUMENT

Patent Document

[Patent Document 1] JP-A-2013-138401

SUMMARY OF THE INVENTION

Problem that the Invention is to Solve

Patent Document 1 described above discloses a structure in which a transmission line allowing electromagnetic waves in a desired frequency band to propagate in a TE10 mode is constituted by a first waveguide having a rectangular sectional shape and a second waveguide having a rectangular sectional shape with one end thereof inserted into the first waveguide at a slight gap, electric wave half mirrors are provided inside the first waveguide and at the leading end of the second waveguide, and the other waveguide is relatively moved in a longitudinal direction with respect to one waveguide to change the gap.

In this structure, the size of the second waveguide inserted into the first waveguide is inevitably smaller than the size of the first waveguide by the thickness of the second waveguide and the interval between the waveguides necessary for movement and a propagatable frequency range in the TE10 mode is different according to the size difference. Accordingly, when the waveguides having a rectangular sectional shape described above are used, it is a prerequisite that the waveguides are used in a region where the propagatable frequency ranges in the TE10 mode determined by the sizes of both waveguides overlap each other.

For example, when a generally known WR-10 waveguide having a size of 2.54×1.27 mm is used as the outer first waveguide, if the required minimum thickness of the second waveguide is about 0.1 mm, and the gap between both waveguides is 30 μm, the size of the second waveguide becomes 2.28×1.01 mm, a lower limit frequency of a propagatable frequency domain in the TE10 mode increases by a decrease in size. For this reason, in order to realize a wide band for a low frequency band, it is necessary to make the thickness of the second waveguide as small as possible.

In case of a filter having a structure in which one waveguide is relatively moved in a longitudinal direction with respect to the other waveguide in a state where waveguides having different sizes are connected as described above, electromagnetic waves leak from the gap between the inside of the outer waveguide and the outside of the inner waveguide, causing deterioration of resonance characteristics.

As a technique for preventing deterioration of resonance characteristics due to leakage of electromagnetic waves, Patent Document 1 discloses a technique in which a groove having a predetermined depth in a direction orthogonal to the longitudinal direction of the waveguide is provided on the inside of the outer waveguide facing the outside of the inner waveguide at a gap, such that electromagnetic waves which enter the gap and reach the groove and electromagnetic waves which are phase-inverted while reciprocating in the groove are cancelled, thereby preventing leakage of electromagnetic waves to the outside.

As conceived from the principle of leakage prevention, the depth of the groove becomes about a ¼ wavelength of a guide wavelength of electromagnetic waves to be a leakage prevention target. If the frequency of the electromagnetic waves to be a leakage prevention target is set to about 100 GHz, the guide wavelength becomes about 4 mm, and the depth of the groove for leakage prevention of about 1 mm is required. The thickness of the outer waveguide may be set to a value taking into consideration the depth of the groove.

However, by further examination of the characteristics of a filter having a structure in which the groove for electromagnetic wave leakage prevention is provided on the inside of the outer waveguide, it is recognized that unnecessary resonance occurs between the leading end (a portion to which the electric wave half mirror is fixed) and the groove provided on the inside of the outer waveguide (hereinafter, referred to as an unnecessary resonator length), and it is understood that the unnecessary resonance frequency changes with the movement of the waveguide.

While the resonance frequency (filter resonance frequency) of the filter itself which is determined by the interval between a pair of electric wave half mirrors becomes high when the mirror interval becomes small, the unnecessary resonance frequency becomes low when the mirror interval becomes small. That is, the change directions of both resonance frequencies with respect to the change of the mirror interval are reversed, and unnecessary resonance disturbs the filter resonance characteristics.

In order to prevent this disturbance, it is considered that, when the mirror interval is the greatest, the unnecessary resonator length is sufficiently greater than the mirror interval. The unnecessary resonance occurs not only at ½ of the wavelength of the electromagnetic waves but also at an odd number multiple of the wavelength of the electromagnetic waves, and the influence of high-order unnecessary resonance is inevitable. Furthermore, if the unnecessary resonator length is made extremely long, it is necessary to increase the overlapping length of the inner waveguide and the outer waveguide, causing an increase in size of the entire filter.

The invention has been accomplished in order to solve the above-described problems, and an object of the invention is to provide a millimeter waveband filter which can vary a resonance frequency in a wide band without causing deterioration of resonance characteristics due to leakage of electromagnetic waves.

Means for Solving the Problem

In order to attain the above-described object, a first aspect of the invention provides a millimeter waveband filter including a first waveguide which has a transmission line to allow electromagnetic waves in a predetermined frequency range of a millimeter waveband to propagate in a TE10 mode, a second waveguide which has a transmission line to allow the electromagnetic waves in the predetermined frequency range to propagate in the TE10 mode and is connected to the first waveguide in a state where at least one end portion of the second waveguide is inserted into the first waveguide, a pair of flat electric wave half mirrors which have characteristics to transmit a part of the electromagnetic waves in the predetermined frequency range and to reflect a part of the electromagnetic waves and are arranged to face each other at an interval in a state where the transmission line of the first waveguide and the transmission line of the second waveguide are blocked, and interval variable means for relatively moving the first waveguide and the second waveguide in a longitudinal direction of the transmission line in a state connected together to change the interval between the pair of electric wave half mirrors. Frequency components centering on a resonance frequency of a resonator formed between the pair of electric wave half mirrors are selectively transmitted, and a groove which has a length along the longitudinal direction of the transmission line corresponding to a ¼ wavelength of electromagnetic waves to be a leakage prevention target is formed on the outside of the second waveguide facing the inside of the first waveguide, and leakage of the electromagnetic waves from the interval between the outside of the second waveguide and the inside of the first waveguide is prevented by the groove.

According to a second aspect of the invention, in the millimeter waveband filter according to the first aspect of the invention, the first waveguide is a square waveguide in which the sectional shape of the transmission line thereof is a rectangular shape, and the second waveguide is a ridge waveguide in which the outside thereof is a rectangular shape at a predetermined gap with respect to the inside of the first waveguide and the sectional shape of the transmission line thereof has a central portion having a height smaller than the height of both side portions.

According to a third aspect of the invention, in the millimeter waveband filter according to the first aspect of the invention, the pair of electric wave half mirrors respectively have rectangular plates which have a predetermined thickness and reflect electromagnetic waves propagating through the transmission line, and slits which are formed in central portions of the plates along a long side direction of the plates and transmit a part of the electromagnetic waves propagating through the transmission line, and the slits are of a ridge type in which a central portion has a height smaller than both side portions, and the thickness of the plates and the height and width of each of both side portions and the central portion of the slits are set such that transmittance to the electromagnetic waves propagating through the transmission line becomes flat in the predetermined frequency range.

According to a fourth aspect of the invention, in the millimeter waveband filter according to the second aspect of the invention, the pair of electric wave half mirrors respectively have rectangular plates which have a predetermined thickness and reflect electromagnetic waves propagating through the transmission line, and slits which are formed in central portions of the plates along a long side direction of the plates and transmit a part of the electromagnetic waves propagating through the transmission line, and the slits are of a ridge type in which a central portion has a height smaller than both side portions, and the thickness of the plates and the height and width of each of both side portions and the central portion of the slits are set such that transmittance to the electromagnetic waves propagating through the transmission line becomes flat in the predetermined frequency range.

According to a fifth aspect of the invention, in the millimeter waveband filter according to the second aspect of the invention, the grooves are provided on both surfaces of the outside on the long side of the second waveguide.

According to a sixth aspect of the invention, in the millimeter waveband filter according to the fourth aspect of the invention, the grooves are provided on both surfaces of the outside on the long side of the second waveguide.

According to a seventh aspect of the invention, in the millimeter waveband filter according to the fifth aspect of the invention, the groove is provided on both surfaces of the outside on the short side of the second waveguide.

According to an eighth aspect of the invention, in the millimeter waveband filter according to the first aspect of the invention, the length of the groove along the longitudinal direction is greater than the depth of the groove.

According to a ninth aspect of the invention, in the millimeter waveband filter according to the second aspect of the invention, the length of the groove along the longitudinal direction is greater than the depth of the groove.

According to a tenth aspect of the invention, in the millimeter waveband filter according to the third aspect of the invention, the length of the groove along the longitudinal direction is greater than the depth of the groove.

According to an eleventh aspect of the invention, in the millimeter waveband filter according to the fourth aspect of the invention, the length of the groove along the longitudinal direction is greater than the depth of the groove.

According to a twelfth aspect of the invention, in the millimeter waveband filter according to the fifth aspect of the invention, the length of the groove along the longitudinal direction is greater than the depth of the groove.

According to a thirteenth aspect of the invention, in the millimeter waveband filter according to the sixth aspect of the invention, the length of the groove along the longitudinal direction is greater than the depth of the groove.

According to a fourteenth aspect of the invention, in the millimeter waveband filter according to the seventh aspect of the invention, the length of the groove along the longitudinal direction is greater than the depth of the groove.

Advantage of the Invention

As described above, in the millimeter waveband filter of the invention, a pair of electric wave half mirrors are respectively provided in the transmission lines of the first waveguide which allows the electromagnetic waves in the predetermined frequency range of the millimeter waveband to propagate in the TE10 mode and the second waveguide which is connected to the first waveguide in a state where one end of the second waveguide is inserted into the first waveguide, these waveguides are relatively moved to vary the interval between the electric wave half mirrors, and the resonance frequency components are selectively transmitted by varying the resonance frequency of the resonator formed between the mirrors. The groove which has the length along the longitudinal direction of the transmission line corresponding to the ¼ wavelength of the electromagnetic waves to be a leakage prevention target is formed on the outside of the second waveguide facing the inside of the first waveguide, and leakage of electromagnetic waves from the gap between the outside of the second waveguide and the inside of the first waveguide is prevented by the groove.

In this way, since the groove which has a length along the longitudinal direction of the transmission line corresponding to the ¼ wavelength of the electromagnetic waves to be a leakage prevention target is provided on the outside of the inner second waveguide, the unnecessary resonator length is unchanged with respect to the change of the mirror interval, and it is possible to prevent the disturbance of the filter characteristics due to the influence of the unnecessary resonance. In addition, since the length representing the leakage prevention action of the groove matches the longitudinal direction of the transmission line, as the thickness of the second waveguide, a depth enough to form the groove having the length may be estimated, and it is possible to sufficiently realize the groove even in the second waveguide having a limited size.

Like a ridge waveguide, a waveguide, in which the height of a central portion of a transmission line is set to be smaller than the higher of both side portions has a characteristic that, even if the sectional area of the transmission line is smaller than a standard square waveguide, electromagnetic waves in a low frequency domain can propagate in the TE10 mode. For this reason, when a ridge waveguide is used as the second waveguide, even if the thickness is increased due to the groove for electromagnetic wave leakage prevention, it is possible to maintain a low frequency band of a propagatable frequency range in the TE10 mode wide, and to achieve a wider band.

When the slits which are provided on the plates of the electric wave half mirrors are of a ridge type in which the height of the central portion is set to be smaller than the height of both side portions, many parameters including the thickness of the plates and the width and height of each of both side portions and the central portion of the slits are selected, whereby it is possible to set the parameters such that transmittance to the electromagnetic waves propagating through the transmission line becomes flat in the predetermined frequency range, and to realize a wider band as a filter.

BEST MODE FOR CARRYING OUT THE INVENTION

Figure 1A:
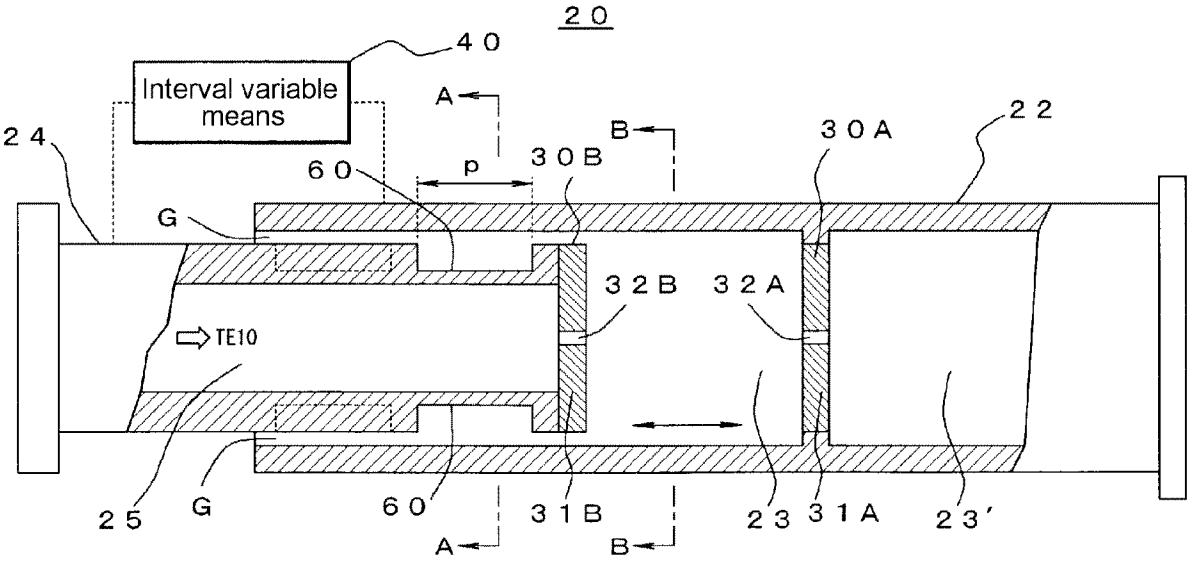
FIGS. 1A to 1C are basic structure diagrams of a millimeter waveband filter of the invention.

Hereinafter, an embodiment of the invention will be described referring to the drawings.

Figure 1C:
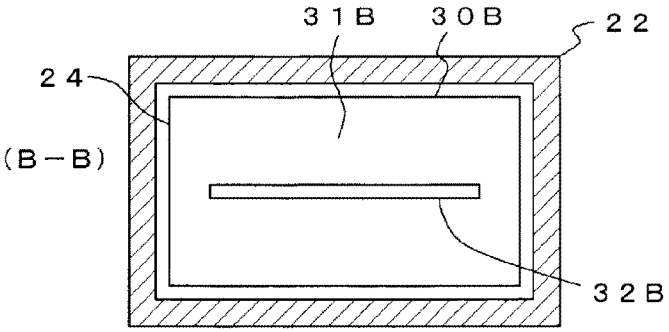
Figure 1B:
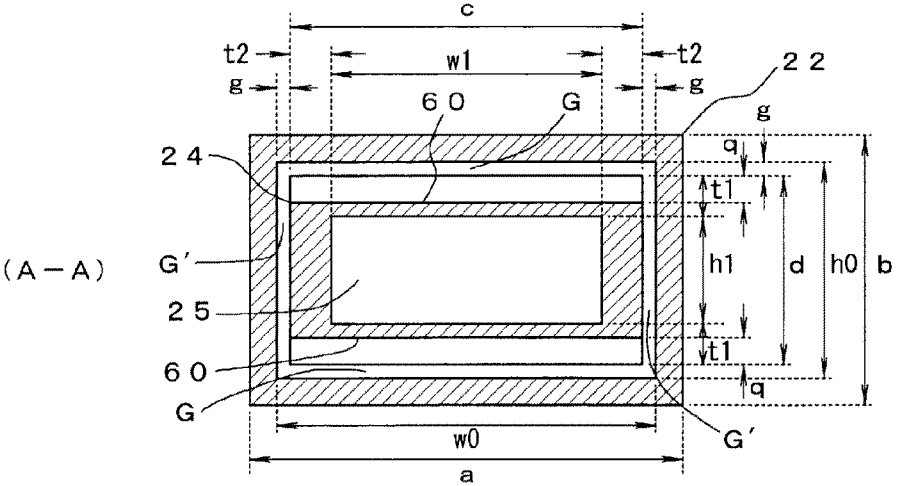

FIGS. 1A to 1C show the basic structure of a millimeter waveband filter 20 of the invention. FIG. 1A is a diagram when a part of the millimeter waveband filter 20 is fractured from the side, FIG. 1B is a sectional view taken along the line A-A of FIG. 1A, and FIG. 1C is a sectional view taken along the line B-B of FIG. 1A.

As shown in FIGS. 1A to 1C, the millimeter waveband filter 20 has a first waveguide 22, a second waveguide 24, a pair of electric wave half mirrors 30A and 30B, and interval variable means 40.

The first waveguide 22 is a square waveguide which has a transmission line 23 having a rectangular sectional shape allowing electromagnetic waves in a predetermined frequency range (for example, 75 to 110 GHz) of a millimeter waveband to propagate in a TE10 mode (single mode). For example, a WR-10 waveguide having a size of w0×h0=2.54×1.27 mm can be used. In FIGS. 1A to 1C, a left transmission line 23 and a right transmission line 23' are separated by the electric wave half mirror 30A. In the basic structure, while the two transmission lines 23 and 23' have the same size, the right transmission line 23' connected to an external circuit may have a standard size corresponding to the WR-10 type, and the size of the left transmission line 23, into which the second waveguide 24 is inserted, may be slightly greater than the standard size (for example, w0'× h0'=2.65×1.47 mm).

Figure 2:
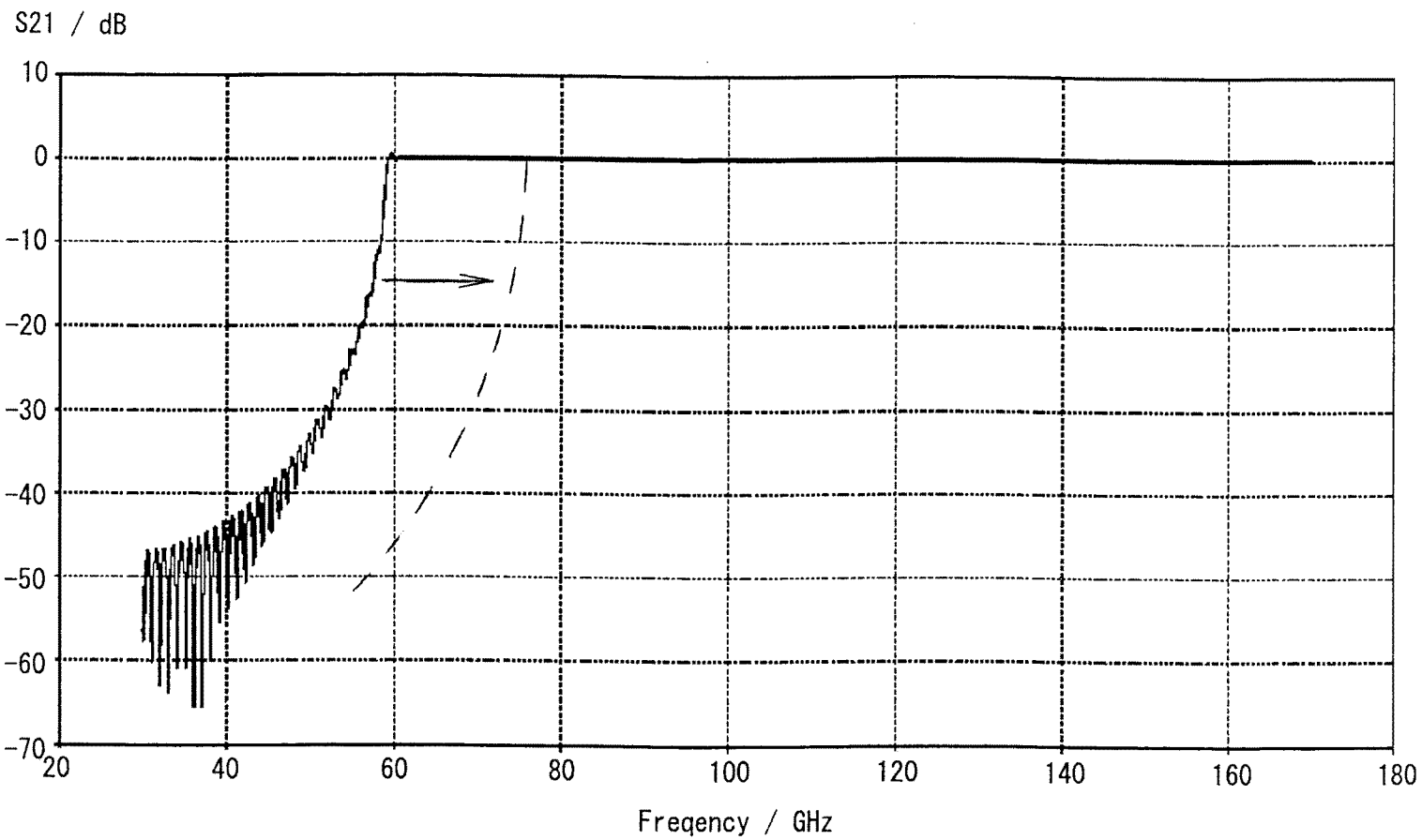
FIG. 2 is a transmission characteristic diagram of a general square waveguide.

FIG. 2 shows a transmission characteristic (S21) of a WR-10 waveguide having a size of w0×h0=2.54×1.27 mm which can be used as the first waveguide 22, and shows a characteristic which has low loss and is flat in a range from a lower limit frequency of 60 GHz to 160 GHz.

The second waveguide 24 has a transmission line 25 which allows the electromagnetic waves in the predetermined frequency range (for example, 75 to 110 GHz) to propagate in the TE10 mode like the first waveguide 22, and is connected to the first waveguide 22 in a state where at least one end thereof is inserted into the first waveguide 22.

When a square waveguide in which the sectional shape of a transmission line thereof is used as the second waveguide 24, the transmission line is thinned by the sum of a gap G, G' necessary for relative movement of the waveguide and the thickness of the waveguide, and as indicated by a dotted line in FIG. 2, a cutoff frequency of a low frequency band is moved to a high frequency band and a usable band is narrowed. Accordingly, a region where the characteristics of the second waveguide 24 and the characteristics of the first waveguide 22 overlap each other becomes a propagatable range in the TE10 mode. The second waveguide 24 will be described as a square waveguide, and modification examples thereof will be described below.

A pair of flat electric wave half mirrors 30A and 30B have characteristics to transmit a part of the electromagnetic waves in the predetermined frequency range and to reflect a part of the electromagnetic waves and are provided so as to face each other at an interval in a state where the transmission line 23 of the first waveguide 22 and the transmission line 25 of the second waveguide 24 are blocked.

Specifically, each of the electric wave half mirrors 30A and 30B has a rectangular outside which blocks the transmission line of the waveguide. One electric wave half mirror 30A is fixed to the middle portion of the transmission line of the first waveguide 22, and the other electric wave half mirror 30B is provided at the leading end (the right end in FIGS. 1A to 1C) of the second waveguide 24.

The electric wave half mirrors 30A and 30B have rectangular plates 31A and 31B which have a predetermined thickness and are made of a metal material to reflect electromagnetic waves propagating through the transmission lines, and slits 32A and 32B which are formed in the central portions of the plates 31A and 31B in the long side direction of the plates 31A and 31B and transmit a part of the electromagnetic waves propagating through the transmission lines.

In regards to the slits 32A and 32B, in FIG. 1C which shows the basic structure of the filter, although a simple structure in which the height is constant over the width direction has been shown, as described above, the height of a portion may be different from other portions.

The interval variable means 40 relatively moves the first waveguide 22 and the second waveguide 24 in the longitudinal direction of the transmission lines in a state connected together to vary the interval between a pair of electric wave half mirrors 30A and 30B, thereby varying the resonance frequency of the filter determined by the interval. Although the specific structure of the interval variable means 40 is arbitrary, specifically, the first waveguide 22 having a large size may be fixed and supported, and the second waveguide 24 may be moved in the longitudinal direction in a state concentric with the first waveguide 22. As a drive method, a configuration in which the rotation power of a motor is converted to linear motion to advance or retreat the second waveguide 24 with respect to the first waveguide 22, or the like can be used.

As shown in FIGS. 1A to 1C, grooves (choke) 60 for electromagnetic wave leakage prevention are formed on the outside at the leading end (the end portion to which the electric wave half mirror 30B is fixed) of the second waveguide 24. In this way, the grooves for electromagnetic wave leakage prevention are provided in the inner second waveguide 24, whereby it is possible to eliminate the change of the unnecessary resonator length with respect to the change of the mirror interval. However, as described above, the required depth as the grooves for electromagnetic wave leakage prevention is about 1 mm, and unlike the device of the related art, it is difficult to realize the grooves in a direction orthogonal to the length direction of the transmission line in view of the size (substantially 2 mm×1 mm) of the first waveguide 22.

Accordingly, the inventors have examined whether or not it is possible to match the length direction representing the electromagnetic wave leakage prevention action with the length direction of the transmission line.

Figure 3A:
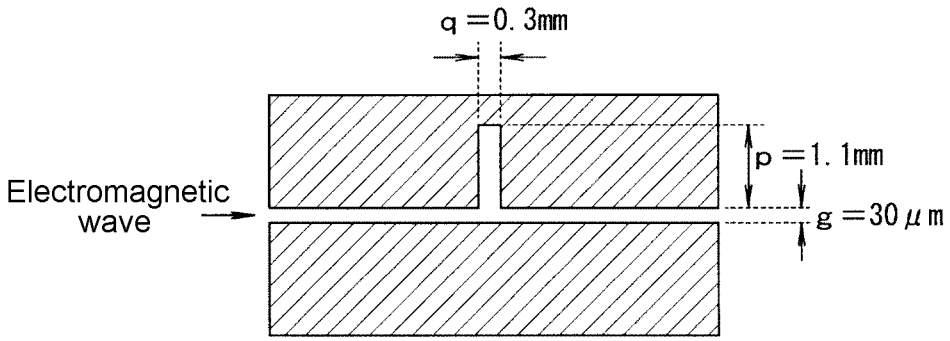
FIGS. 3A and 3B are model diagrams when a length direction of a groove for electromagnetic wave leakage prevention is changed with respect to a gap.
Figure 3B:
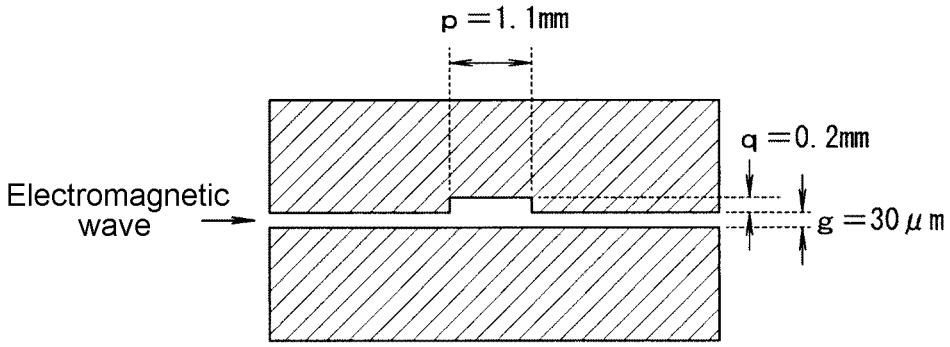
Figure 4:
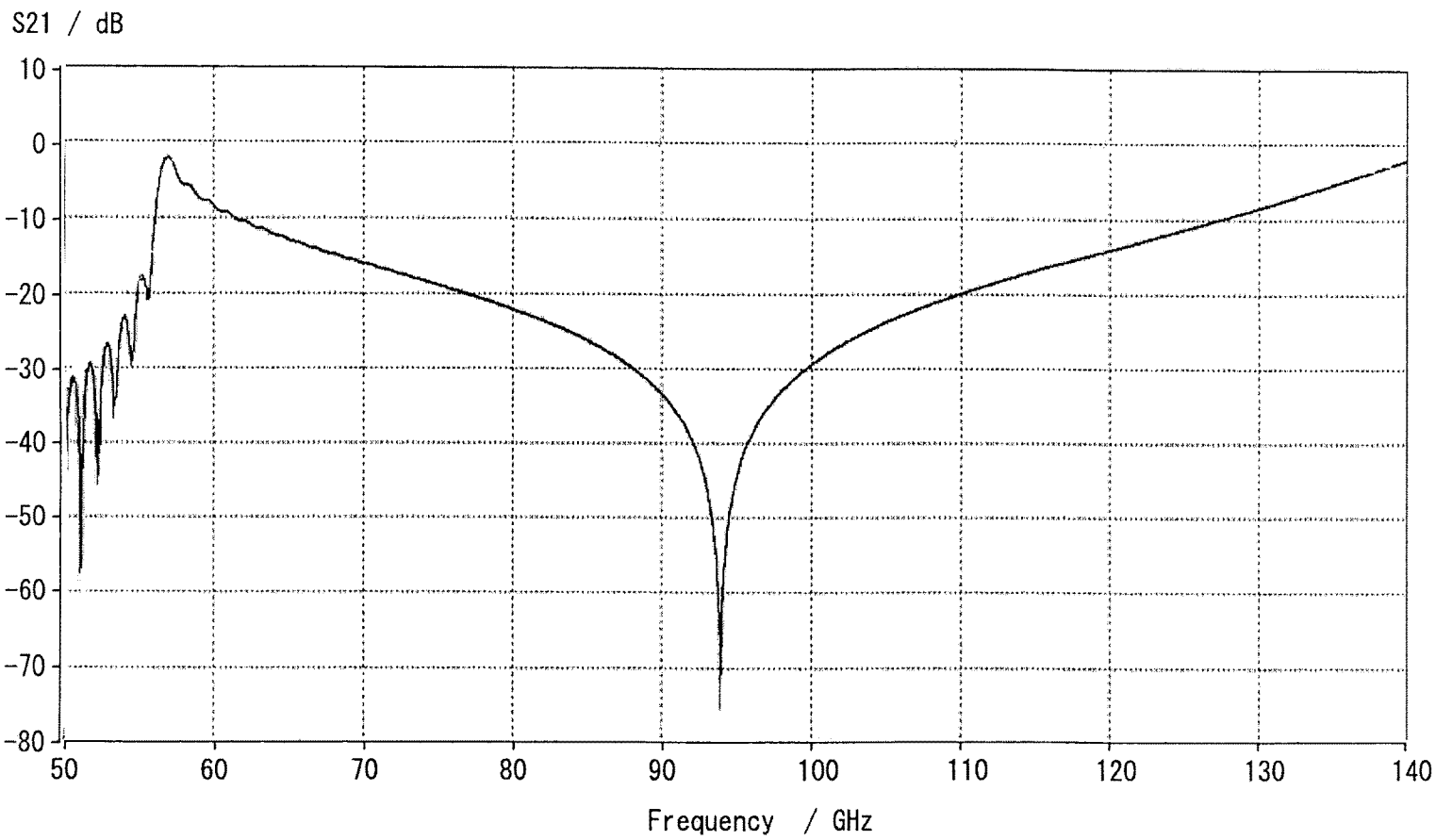
FIG. 4 shows a simulation result of a model in which a propagation direction of electromagnetic waves propagating through a gap is orthogonal to a length direction of a groove for electromagnetic wave leakage prevention.
Figure 5:
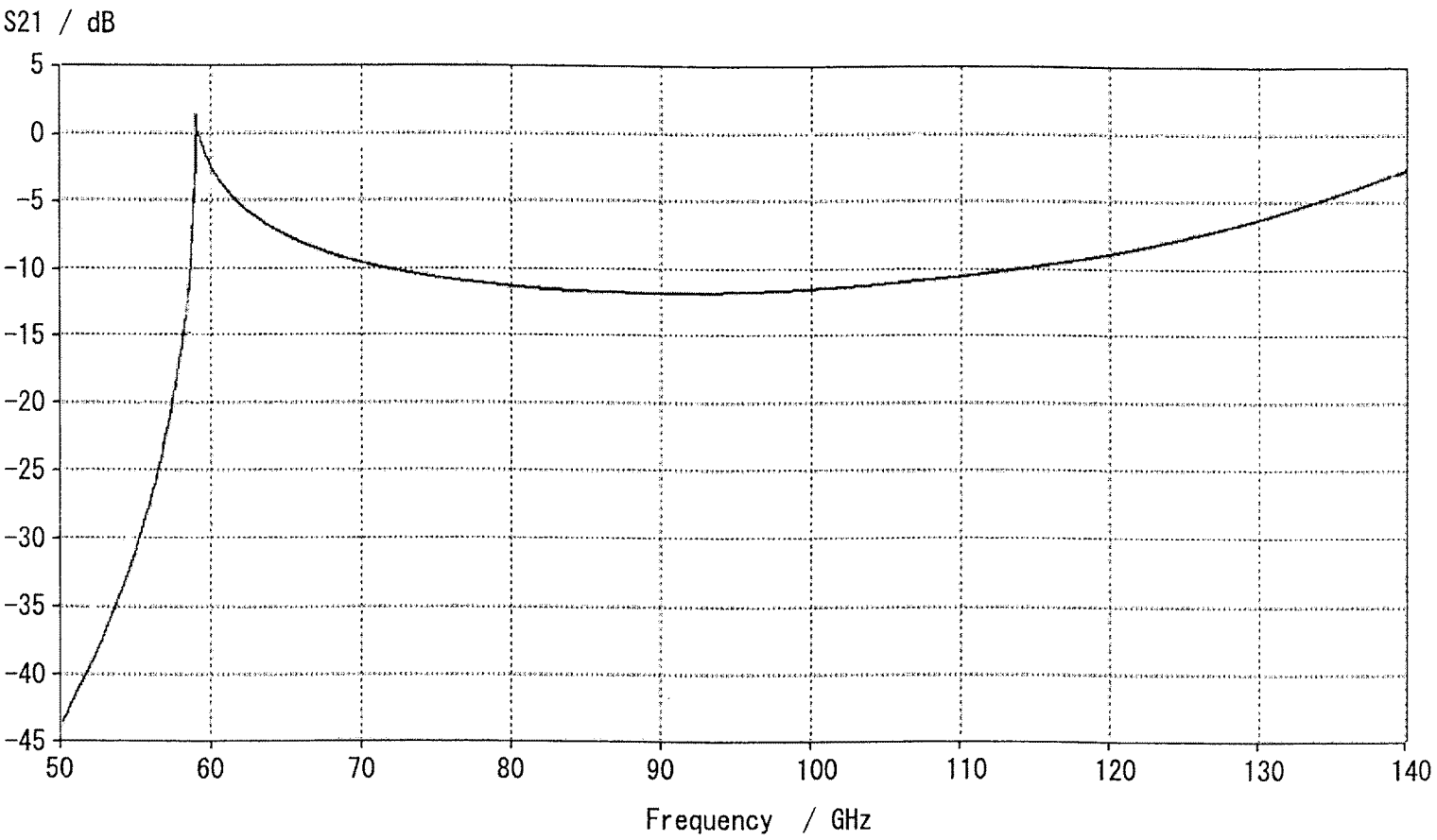
FIG. 5 shows a simulation result of a model in which a propagation direction of electromagnetic waves propagating through a gap is parallel to a length direction of a groove for electromagnetic wave leakage prevention.

FIG. 3A shows a related art model in which a groove having a length of 1.1 mm and a width of 0.3 mm is provided so as to be orthogonal to a gap of 30 μm (transmission line by the interval), and FIG. 3B shows an examination model in which a groove having a length of 1.1 mm and a depth of 0.2 mm is provided along a gap of 30 μm. The transmission characteristic of the related art model is obtained as shown in FIG. 4, and the transmission characteristic of the examination model is obtained as shown in FIG. 5.

In comparison of both in a range of 70 to 120 GHz, it is understood that the related art model obtains large attenuation compared to the examination model, and in particular, undergoes steep attenuation at 94 GHz. However, even in the examination model, attenuation of 10 dB is obtained in the above-described frequency range, and if the attenuation is not sufficient, it is possible to cope with this by forming a groove having the same shape in a plurality of stages along the length direction of the transmission line. From this result, it can be confirmed that the groove for electromagnetic wave leakage prevention can be formed so as to match the length direction representing the electromagnetic wave leakage prevention action with the length direction of the transmission line, and this technique can be sufficiently applied to the second waveguide 24 having a thickness of about 0.3 mm.

The millimeter waveband filter 20 shown in FIGS. 1A to 1C uses the examined technique described above, and the grooves 60 for electromagnetic wave leakage prevention are provided on the upper and lower outside surfaces close to the leading end of the second waveguide 24 facing the inside surface of the first waveguide 22 at the gap G such that the length direction representing the electromagnetic wave leakage prevention action of the grooves becomes the length direction of the transmission lines.

That is, each groove 60 having a length (along the longitudinal direction) of p=about 1 mm representing the electromagnetic wave leakage prevention action is formed at a depth of about q=0.2 mm. Even when the grooves are provided in such a direction, since the phase of electromagnetic wave propagating and returning from the edge of the groove 60 close to the half mirror to the edge away from the half mirror changes by $\lambda/2$ and input and output are cancelled (a choke effect in which impedance significantly increases with respect to leakage of electromagnetic waves is exhibited), an electromagnetic wave leakage prevention effect is obtained.

While it is expected that the electromagnetic wave leakage prevention effect by the grooves 60 is attenuation of about 10 dB from the examination model, as indicated by a dotted line of FIG. 1A, the grooves 60 are arranged in a plurality of stages along the length direction of the transmission line (while two stages are shown in FIGS. 1A to 7C, the overlapping length of the waveguides may be extended and three or more stages may be provided), whereby it is possible to obtain a larger amount of attenuation.

Although the grooves 60 are provided on the outsides of the upper and lower sides (the long side) of the second waveguide 24 having a high electromagnetic wave leakage prevention effect, grooves may be also provided on the outsides of the right and left sides (the short side) facing the insides on the right and left sides (the short side) of the first waveguide 22 at the gap G'.

In this way, the millimeter waveband filter has a structure in which the first and second waveguides 22 and 24 having different sizes are connected, and the electric wave half mirrors 30A and 30B are fixed in a state facing each other in the transmission line of the outer first waveguide 22 and the transmission line of the inner second waveguide 24, and one waveguide is relatively moved with respect to the other waveguide to vary the mirror interval, thereby varying the resonance frequency of the filter. In this millimeter waveband filter, a structure in which the electromagnetic waves leaking from the gap between the first waveguide 22 and the second waveguide 24 are prevented by the grooves 60 formed on the outside of the second waveguide 24 along the length direction of the transmission line matching the length direction representing the electromagnetic wave leakage action is used. With this, the distance (unnecessary resonator length) from the electric wave half mirror 30 to the groove 60 is constant, and the distance is made sufficiently smaller than the mirror interval, thereby preventing the disturbance of the resonance characteristics of the filter due to unnecessary resonance.

As the thickness of the second waveguide 24, a depth enough to form the groove regardless of the length representing the electromagnetic wave leakage prevention action may be estimated, and it is possible to sufficiently realize the groove even in the second waveguide having a limited size.

A dimension example of the second waveguide 24 will be described. If the size of the first waveguide 22 is set to 2.65×1.47 mm greater than a standard size as described above, and the gap g between the first waveguide 22 and the second waveguide 24 is set to 30 μm, the size c×d of the second waveguide 24 becomes 2.59×1.41 mm, and if the thickness t1 of the upper and lower sides (the long side) is 0.3 mm which is the sum of the required minimum thickness of 0.1 mm and the depth of the groove 60 of 0.2 mm, the height h1 of the transmission line becomes 1.41-2×0.3=0.81 mm. If the aspect ratio of the size of the second waveguide 24 is set to 1:2, the width w1 of the transmission line becomes 1.62 mm, and the thickness t2 of the right and left sides (the short side) becomes (2.59-1.62)/2=0.485 mm. In FIG. 1, the outside a×b of the first waveguide 22 is greater than the size w0×h0 and is arbitrary in a range where strength as a structure is obtained.

In the millimeter waveband filter 20 having the above-described basic structure, since the second waveguide 24 is a square waveguide, and the grooves 60 having a depth of about 0.2 mm are formed on the outside thereof, the required minimum thickness of about 0.3 mm is required, and the low frequency band of the frequency range of the electromagnetic waves which can propagate through the second waveguide 24 in the TE10 mode is narrowed compared to the first waveguide 22 by an increase in thickness.

Accordingly, when a wider band characteristic in a low frequency band is required, it is necessary that a waveguide which has a small size but has a passing characteristics extending to the low frequency band is used as the inner second waveguide 24.

For example, it is considered that a so-called ridge waveguide in which protrusions protruding in a direction approaching each other from the centers of both insides on the long side of the waveguide are continuously formed in the length direction, and the sectional shape of a transmission line thereof is substantially an H shape is used.

Figure 6A:
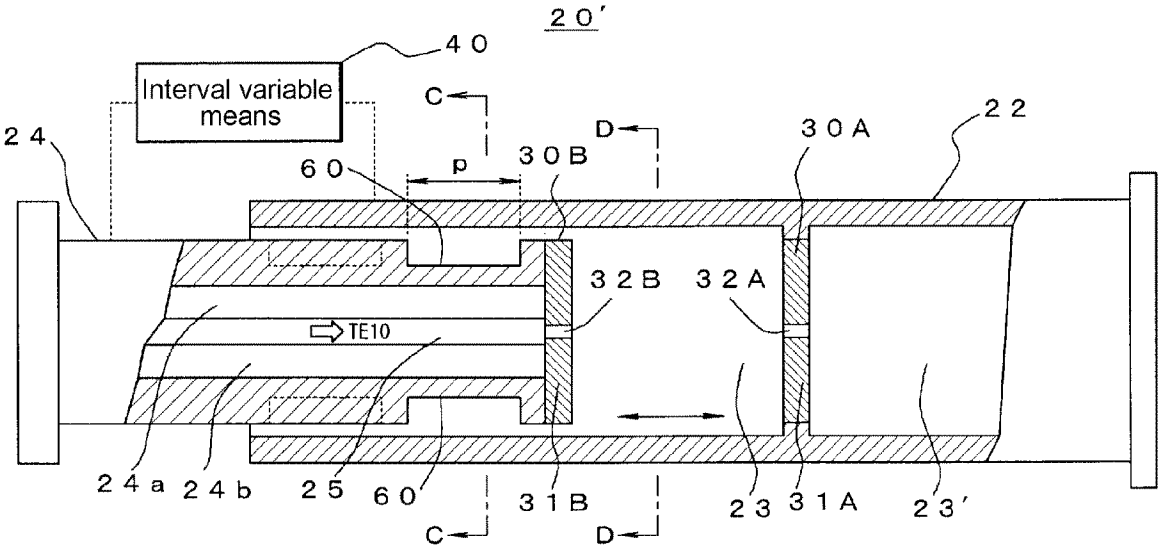
FIGS. 6A to 6C are specific structure diagrams of a millimeter waveband filter of the invention.
Figure 6C:
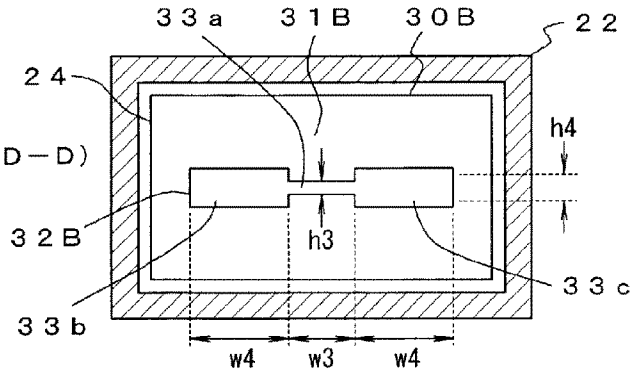
Figure 6B:
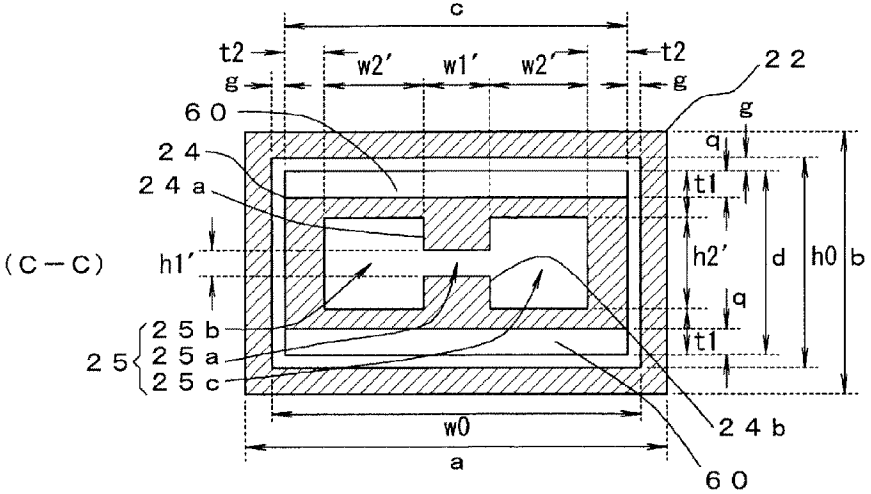

In case of this ridge waveguide, the width and height of the central portion of the transmission line and the width and height of both side portions are selected, whereby it is possible to allow the electromagnetic waves in the equivalent frequency range to propagate in the TE10 mode with the sectional shape smaller than the sectional shape of the transmission line of the standard square waveguide FIGS. 6A to 6C show the structure of a millimeter waveband filter 20' in which a ridge waveguide is used as the inner second waveguide 24.

Figure 7:
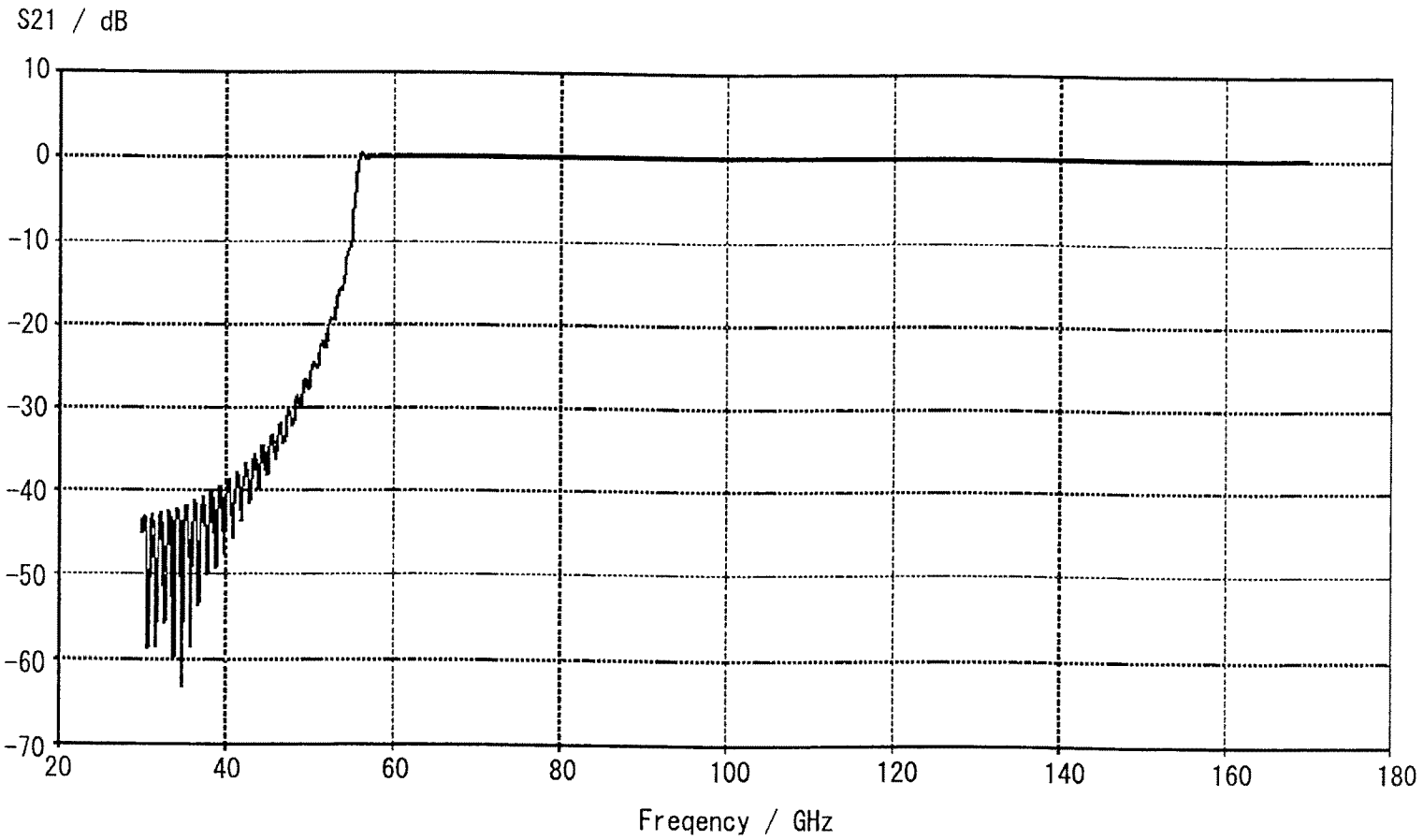
FIG. 7 is a transmission characteristic diagram of a ridge waveguide.

As a dimension example of the second waveguide 24 of this embodiment, similarly, the gap g with respect to the inside of the first waveguide 22 is set to 30 μm, the size is set to c×d=2.59×1.41 mm, the width and height of a central portion 25*a* of the transmission line are set to w1'=0.5 mm and h1'=0.27 mm, the width and height of side portions 25*b* and 25*c* of the transmission line are set to w2'=0.72 mm and h2'=0.67 mm, the thickness of the upper and lower sides (the long side) is set to t1=0.37 mm, the thickness of the right and left sides (the short side) is set to t2=0.325 mm, and the transmission characteristic (S21) of the waveguide having this shape is as shown in FIG. 7.

As will be apparent from FIG. 7, even though the sectional shape of the second waveguide 24 has a size significantly smaller than the sectional shape of the transmission line of the standard WR-10 waveguide shown in FIG. 2, the lower limit frequency is lowered to about 56 GHz.

Accordingly, even if the ridge waveguide is used as the second waveguide 24, it is possible to allow electromagnetic waves in a predetermined frequency range (75 to 110 GHz) for use to propagate in the TE10 mode with low loss, and to further widen the low frequency band.

In addition, in the second waveguide 24, since the thickness t1 of the upper and lower sides is 0.37 mm, as described above, it is possible to reasonably form the grooves 60 for electromagnetic wave leakage prevention having a depth of about 0.2 mm, to prevent deterioration of characteristics due to leakage of electromagnetic waves, and to realize a wide band as a filter.

Although a dimension example where the lower limit frequency of the propagatable frequency band of the second waveguide 24 becomes lower than the lower limit frequency (in the example of FIG. 2, 60 GHz) of the propagatable frequency band of the first waveguide 22 has been described, the shape of the transmission line of the second waveguide 24 may be set taking into consideration the required frequency band and the thickness necessary for forming the grooves 60.

As described above, as a result of various examinations on the reflection characteristic of the electric wave half mirrors 30A and 30B, it has been confirmed that, as in the millimeter waveband filter having the basic structure, if the slits have a shape at a constant height, fluctuation in transmittance in a desired frequency range is observed.

Figure 8:
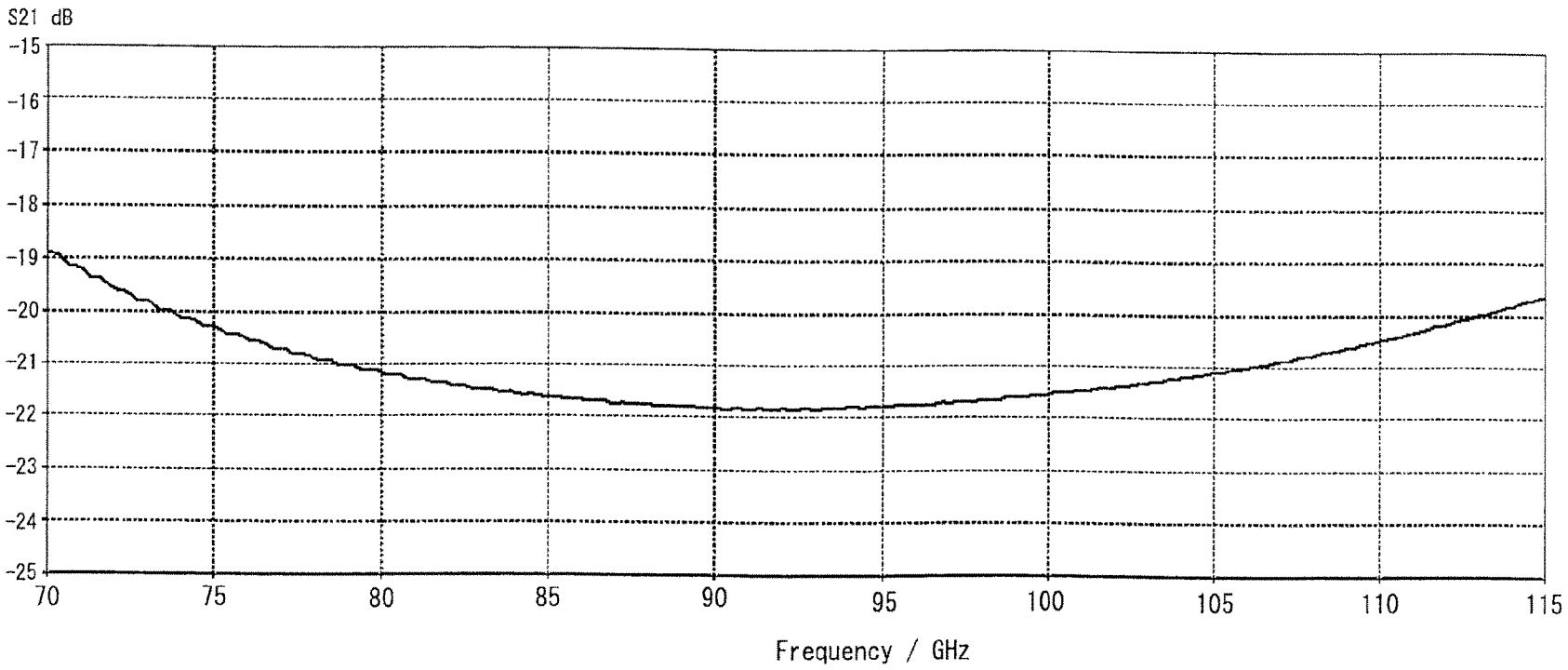
FIG. 8 is a transmission characteristic diagram of an electric wave half mirror in which a height of a slit is constant.

FIG. 8 shows a transmission characteristic of a single mirror when the slit 32A (32B) in the plate 31A (31B) having a thickness of 1 mm has a constant height of 50 μm (a transmission characteristic in a state where the electric wave half mirror is provided in the transmission line having the same outside as the plate), and shows a downward convex change in a range of 70 to 115 GHz.

In order to cope with this, in the millimeter waveband filter 20' shown in FIGS. 6A to 6C, as shown in FIG. 6C, as the slit 32B of the electric wave half mirror 30B, a ridge type is provided corresponding to the sectional shape of the transmission line 25 of the second waveguide 24 such that the height h3 of a central portion 33*a* having a width w3 is set to be smaller than the height h4 of side portions 33*b* and 33*c* having a width w4. Though not shown, the same slit shape applies to the other electric wave half mirror 30A.

Figure 9:
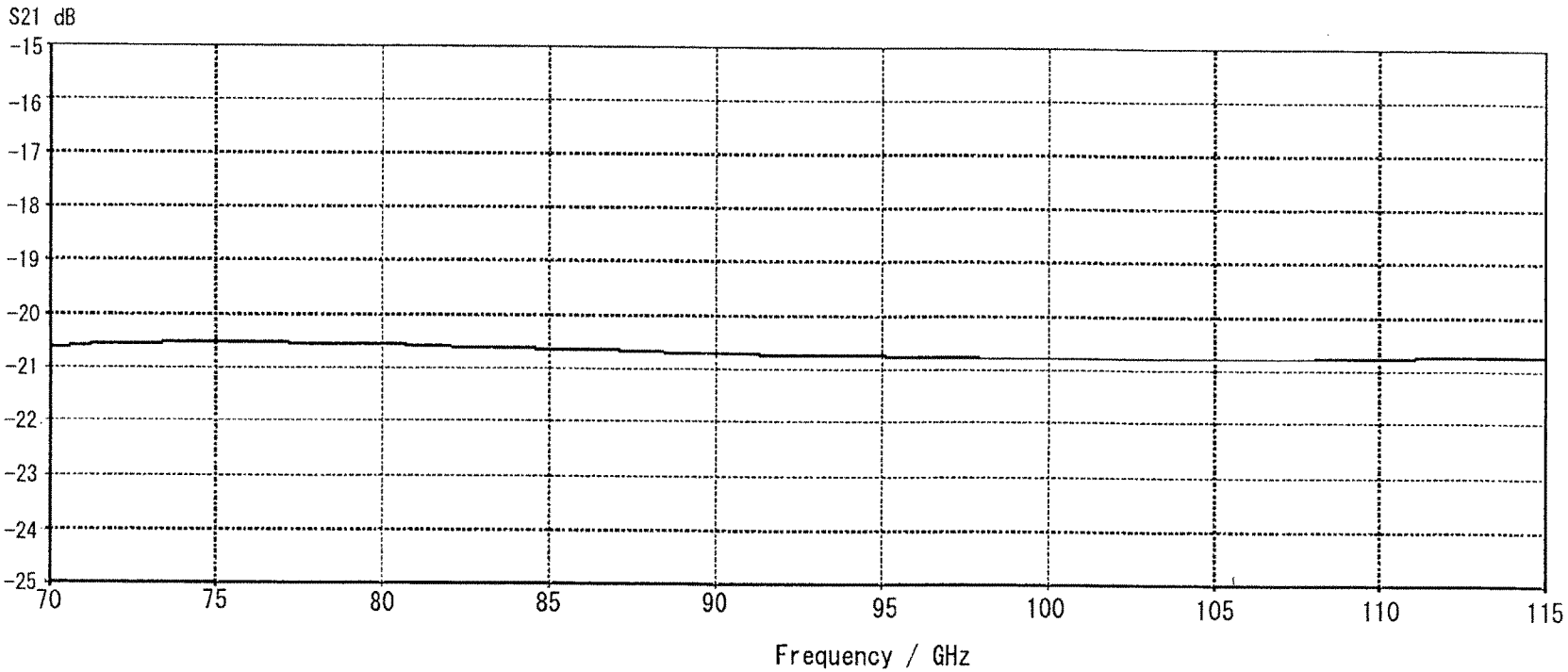
FIG. 9 is a transmission characteristic diagram of an electric wave half mirror having a ridge slit shown in FIGS. 6A to 6C.

With this slit shape, for example, a transmission characteristic of a single mirror when the plate thickness is 0.7 mm, the width and height of the central portion 33*a* of the slit are w3=0.5 mm and h3=40 μm, and the width and height of both side portions 33*b* and 33*c* are w4=1.02 mm and h4=0.2 mm (a transmission characteristic in a state where the electric wave half mirror is provided in the transmission line having the same outside as the plate) is shown in FIG. 9. As shown in FIG. 9, a flat transmission characteristic over a wide range of flat 70 to 115 GHz is shown.

The above-described numerical example is a result obtained by changing the parameters, such as the plate thickness and the width and height of each of the central portion and both side portions of the slit, in various ways. Although the numerical values are not intended to specify the invention, as described above, it has been confirmed that portions having different heights are provided in the slit, and changes in characteristic to changes in increased parameters are recognized to set the parameters, thereby making the transmission characteristic of the electric wave half mirror flat.

Though not described in detail, in regards to the tendency of changes in characteristic to changes in parameters, as the height h3 of the central portion 33*a* of the slit increases, transmittance increases in the entire frequency band, and a noticeable change in transmission characteristic to a change in the height h4 of both side portions 33*b* and 33*c* does not appear. As the width w3 of the central portion 33*a* decreases (that is, the width w4 of both side portions 33*b* and 33*c* increases), transmittance tends to increase in the entire frequency band. The gradient of the transmission characteristic largely changes to change in plate thickness, and as the thickness increases in a predetermined range, the gradient of the transmission characteristic changes from negative to positive.

Accordingly, the plate thickness is set to a value such that the gradient of the transmission characteristic becomes substantially 0 (the transmission characteristic is substantially parallel to a frequency axis), and the height h3 and width w3 of the central portion 33*a* of the slit are set to values such that preferable transmittance (for example, about 20 dB) as a half mirror for use in a resonator, whereby it is possible to make the transmission characteristic flat. The above-described numerical example shows an example.

Figure 10:
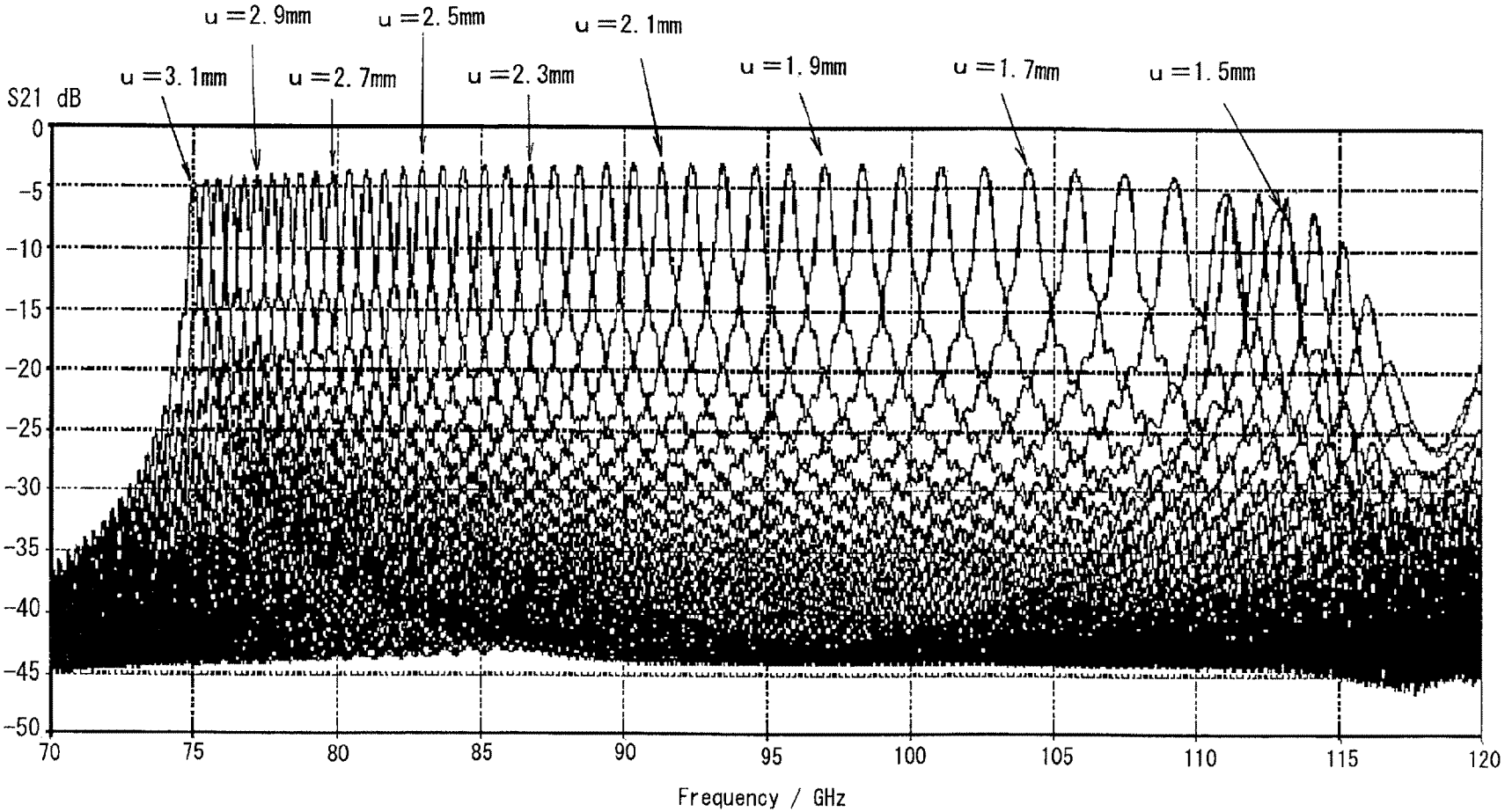
FIG. 10 is a transmission characteristic diagram when a half mirror interval varies in the millimeter waveband filter shown in FIGS. 6A to 6C.

FIG. 10 shows a transmission characteristic when a half mirror interval u is varied from 3.1 mm to 1.5 mm with 0.04 mm step in the millimeter waveband filter 20' shown in FIGS. 6A to 6C.

As will be apparent from the drawing, it is understood that a filter characteristic with substantially constant loss in a predetermined frequency range of 75 to 110 GHz is obtained through the use of a small and thick ridge waveguide as the second waveguide 24 and the groove 60 for electromagnetic wave leakage prevention which is provided on the outside along the length direction of the transmission line.

In FIG. 10, a peak which appears near a characteristic of a half mirror interval u=1.5 mm (equal to or greater than 111 GHz) is sub-resonance when the half mirror interval u is wide (3.1 mm to 2.9 mm). A drop near 117 GHz is loss due to the occurrence of a different mode (LSE11), and when a square waveguide is used as the second waveguide 24, a peak which occurs in a usage band. However, a peak can be moved to a band higher than the usage band by using a ridge waveguide.

DESCRIPTION OF REFERENCE NUMERALS AND SIGNS

20, 20': millimeter waveband filter, 22: first waveguide, 23, 23': transmission line (the inside of the first waveguide), 24: second waveguide, 25: transmission line (the inside of the second waveguide), 25*a*: central portion, 25*b*, 25*c*: side portion, 30A, 30B: electric wave half mirror, 31A, 31B: plate, 32A, 32B: slit, 33*a*: central portion, 33*b*: side portion, 40: interval variable means, 60: groove

What is claimed is:

1. A millimeter waveband filter comprising:

a first waveguide which has a transmission line to allow electromagnetic waves in a predetermined frequency range of a millimeter waveband to propagate in a TE10 mode;

a second waveguide which has a transmission line to allow the electromagnetic waves in the predetermined frequency range to propagate in the TE10 mode and is connected to the first waveguide in a state where at least one end portion of the second waveguide is inserted into the first waveguide;

a pair of flat electric wave half mirrors which have characteristics to transmit a part of the electromagnetic waves in the predetermined frequency range and to reflect a part of the electromagnetic waves and are arranged to face each other at an interval in a state where the transmission line of the first waveguide and the transmission line of the second waveguide are blocked; and variable interval means for relatively moving the first waveguide and the second waveguide in a longitudinal direction of the transmission line in a state connected together to change the interval between the pair of electric wave half mirrors, wherein frequency components centering on a resonance frequency of a resonator formed between the pair of electric wave half mirrors are selectively transmitted, and a groove which has a length along the longitudinal direction of the transmission line corresponding to a ¼ wavelength of electromagnetic waves to be a leakage prevention target is formed on the outside of the second waveguide facing the inside of the first waveguide, and leakage of the electromagnetic waves from the interval between the outside of the second waveguide and the inside of the first waveguide is prevented by the groove, wherein the pair of electric wave half mirrors respectively have rectangular plates which have a predetermined thickness and reflect electromagnetic waves propagating through the transmission line, and slits which are formed in central portions of the plates along a long side direction of the plates and transmit a part of the electromagnetic waves propagating through the transmission line, the slits are of a ridge type in which a central portion has a height smaller than both side portions, and the thickness of the plates and the height and width of each of both side portions and the central portion of the slits are set such that transmittance to the electromagnetic waves propagating through the transmission line becomes flat in the predetermined frequency range, the predetermined frequency range is 75 to 110 GHz, and the transmittance of the electric wave half mirrors is about −20 dB.

2. The millimeter waveband filter according to claim 1, wherein the first waveguide is a rectangular waveguide in which the sectional shape of the transmission line thereof is a rectangular shape, and the second waveguide is a ridge waveguide in which the outside thereof is a rectangular shape at a predetermined gap with respect to the inside of the first waveguide and the sectional shape of the transmission line thereof has a central portion having a height smaller than the height of both side portions.

3. The millimeter waveband filter according to claim 2, wherein the grooves are provided on both surfaces of the outside on the long side of the second waveguide.

4. The millimeter waveband filter according to claim 3, wherein the length of the groove along the longitudinal direction is greater than the depth of the groove, the gap between the outside of the second waveguide and the inside of first waveguide is smaller than the depth of the groove, and the depth of the groove is about 0.2 mm.

5. The millimeter waveband filter according to claim 4, wherein a thickness of the second waveguide is about 0.3 mm.

6. The millimeter waveband filter according to claim 2, wherein the length of the groove along the longitudinal direction is greater than the depth of the groove, the gap between the outside of the second waveguide and the inside of first waveguide is smaller than the depth of the groove, and the depth of the groove is about 0.2 mm.

7. The millimeter waveband filter according to claim 6, wherein a thickness of the second waveguide is about 0.3 mm.

8. The millimeter waveband filter according to claim 1, wherein the length of the groove along the longitudinal direction is greater than the depth of the groove, the gap between the outside of the second waveguide and the inside of first waveguide is smaller than the depth of the groove, and the depth of the groove is about 0.2 mm.

* * * * *